US006924693B1

(12) United States Patent
Black

(10) Patent No.: US 6,924,693 B1
(45) Date of Patent: Aug. 2, 2005

(54) CURRENT SOURCE SELF-BIASING CIRCUIT AND METHOD

(75) Inventor: William C. Black, Ames, IA (US)

(73) Assignee: Xilinx, Inc., San Jose, CA (US)

( * ) Notice: Subject to any disclaimer, the term of this patent is extended or adjusted under 35 U.S.C. 154(b) by 26 days.

(21) Appl. No.: 10/217,759

(22) Filed: Aug. 12, 2002

(51) Int. Cl.[7] ..... G05F 1/10; G05F 3/02
(52) U.S. Cl. ..... 327/543; 327/541; 323/315
(58) Field of Search ..... 327/538, 540–541, 327/543; 323/315, 312, 316

(56) References Cited

U.S. PATENT DOCUMENTS 5,440,277 A * 8/1995 Ewen et al. ..... 331/176
5,696,440 A * 12/1997 Harada ..... 323/315
6,107,868 A * 8/2000 Diniz et al. ..... 327/543
6,424,174 B1 * 7/2002 Nowak et al. ..... 326/81
6,498,528 B2 * 12/2002 Inagaki et al. ..... 327/541
2002/0074616 A1 * 6/2002 Chen et al. ..... 257/516

OTHER PUBLICATIONS

R. Jacob Baker, Harry W. Li, David E. Boyce, CMOS Circuit Design, Layout, and Simulation, Series on Microelectronic Systems, 1998, 469–484, IEEE Press, New York.

* cited by examiner

*Primary Examiner*—Quan Tra
(74) *Attorney, Agent, or Firm*—W. Eric Webostad

(57) ABSTRACT

Method and apparatus for a nonlinear current circuit element are described, and method and apparatus using the nonlinear current circuit element in current-source self-biasing circuits are described. In one embodiment, a transistor is provided having source and drain terminals coupled together. This transistor has a significant gate tunneling current used beneficially to provide a nonlinear current circuit element. This nonlinear current circuit element is used in a plurality of current-source self-biasing circuits.

20 Claims, 5 Drawing Sheets

CURRENT SOURCE SELF-BIASING CIRCUIT AND METHOD

FIELD OF THE INVENTION

The present invention relates generally to a tunneling current circuit element, and more particularly to a current source self-biasing circuit using a tunneling current circuit element.

BACKGROUND OF THE INVENTION

The semiconductor industry continues to make smaller and smaller integrated circuits. This reduction in size of an integrated circuit is in part due to smaller lithographies. Accordingly, devices made from smaller lithographies are scaled down as well. With respect to a transistor, gate insulator thickness ("gate oxide" or more accurately "gate dielectric") has become thinner as devices have become smaller.

A thin gate dielectric conventionally is not as insulative as a thicker gate dielectric because of electron tunneling across the dielectric. In order to prevent tunneling currents from negatively impacting transistor operation, materials other than silicon oxide have evolved for use as transistor gate dielectrics including, but not limited to, nitrides such as silicon nitride. Moreover, substantial effort has been made to create high quality dielectrics for thin gate insulators. By thin gate insulator is meant an oxide or other dielectric having a thickness of less than approximately 20 Angstroms. Such a thin gate insulator is conventionally formed using a process having a lithographic minimum dimension of about 0.1 microns (100 nanometers) or less. But forming an oxide or other dielectric that is 20 Angstroms or less in thickness is problematic. Thus, MOSFETs (metal-oxide-semiconductor-field-effect-transistors) may comprise a combination of materials, such as layering of silicon nitride and silicon dioxide in order to form a gate that is as thin as possible but which limits tunneling current.

Power supply independent current reference circuits conventionally use components with differing current-voltage (I-V) characteristics in conjunction with a current mirror circuit and other components to generate reference current or currents which are a weak function of a power supply voltage. Alternatively, voltages may be similarly generated in, for example, voltage proportional to absolute temperature (PTAT) circuits and bandgap generation circuits that conventionally use two or more bipolar junction transistors (BJTs).

A problem faced by the semiconductor industry is that MOSFET-only self-biasing circuits, such as a threshold reference self-biasing circuit, generate voltages that tend to vary from wafer to wafer and may also vary over time. Moreover, MOSFET-only self-biasing circuits may substantially drift with temperature. Accordingly, such high sensitivity to process variability and temperature drift makes MOSFET-only self-biasing circuits problematic.

Self-biasing circuits formed with one or more BJTs are conventionally formed using bipolar and metal-oxide-semiconductor (MOS) processes. Contemporary MOS processes combine P and N type MOS devices on what is commonly known as a CMOS or complementary MOS process. These CMOS processes usually allow parasitic BJT transistors to be fabricated along with P and N type MOSFETs without requiring additional process steps. However, as supply voltages are reduced, BJTs are more difficult to use with CMOS circuits. In order to maintain reliable performance, contemporary MOS circuits with lithographic dimensions on the order of 100 nm have reduced supply voltage, Vdd, to approximately one volt. Conventional silicon BJTs require a forward base-emitter voltage of approximately 0.7 volts. Thus, there is limited margin for operation of such BJTs with low voltage MOS circuits. Moreover, the parasitic BJTS that are easily available on advanced CMOS processes usually exhibit very low current gain, on the order of one. This very low current gain can lead to poor reference performance with conventional design strategies.

Accordingly, it would be desirable and useful to provide a self-biasing circuit formed with only MOSFETs that is less susceptible to process variation and temperature.

SUMMARY OF THE INVENTION

An aspect of the present invention is a nonlinear circuit element. A transistor-like device having a gate, a gate insulator, and a substrate or well or spaced-apart source and drain regions has the gate connected to an input terminal, and the substrate, well or the spaced-apart source and drain regions connected to an output terminal.

Another aspect of the present invention is a current source self-biasing circuit in which a current mirror circuit is configured to sense a first current at a first node and provide a second current at a second node. A current gating transistor is coupled to the first node and configured to pass or impede the first current to a third node in response to a gating voltage. A first resistive load is configured to receive current from the third node. A second load device is configured to receive the second current, where the second load device comprises a nonlinear transistor-like device having a gate input node and a substrate, well or spaced-apart source and drain regions connected to an output node, typically ground or a power supply voltage.

Another aspect of the present invention is a method of providing a nonlinear load device. A transistor-like device is formed having a gate, a source region, and a gate insulator of limited thickness for passing current from the gate to the source region. The transistor-like device may be implemented as a transistor with a gate and both source and drain regions, the source and drain regions being optionally connected together at a single node, or a two-terminal device having a gate and a substrate or well region that under proper biasing conditions will behave as the source or sink of tunneling current to or from the gate. The gate provides an input terminal to the non-linear load device, and the applicable, source, drain, well or substrate regions provide an output terminal.

Another aspect of the present invention is a method of providing the current source self-biasing circuit. A current mirror circuit is coupled to sense a first current and provide a second current. The first current is gated to a first resistive load. The second current is provided to a second load composed of a transistor-like device. The transistor-like device has a gate, a source region, possibly a drain region coupled to the source region, and a gate insulator of limited thickness for providing passage of leakage current from the gate to the source region (and drain region if present). The gate provides an input terminal to the non-linear load device, and if both source and drain regions are provided, the source and drain regions are coupled to one another to provide an output terminal. The potential at this second load device is compared with the potential at the first load device and operatively connected to the gating device of the first load device so as to result in comparable potentials at the first and second loads.

An advantage of the present invention is that the tunneling current device has a current to voltage relationship that is only slightly dependent on temperature.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the present invention may admit to other equally effective embodiments.

DETAILED DESCRIPTION OF THE DRAWINGS

In the following description, numerous specific details are set forth to provide a more thorough understanding of the present invention. However, it will be apparent to one of skill in the art that the present invention may be practiced without one or more of these specific details. In other instances, well-known features have not been described in order to avoid obscuring the present invention.

Figure 1A:
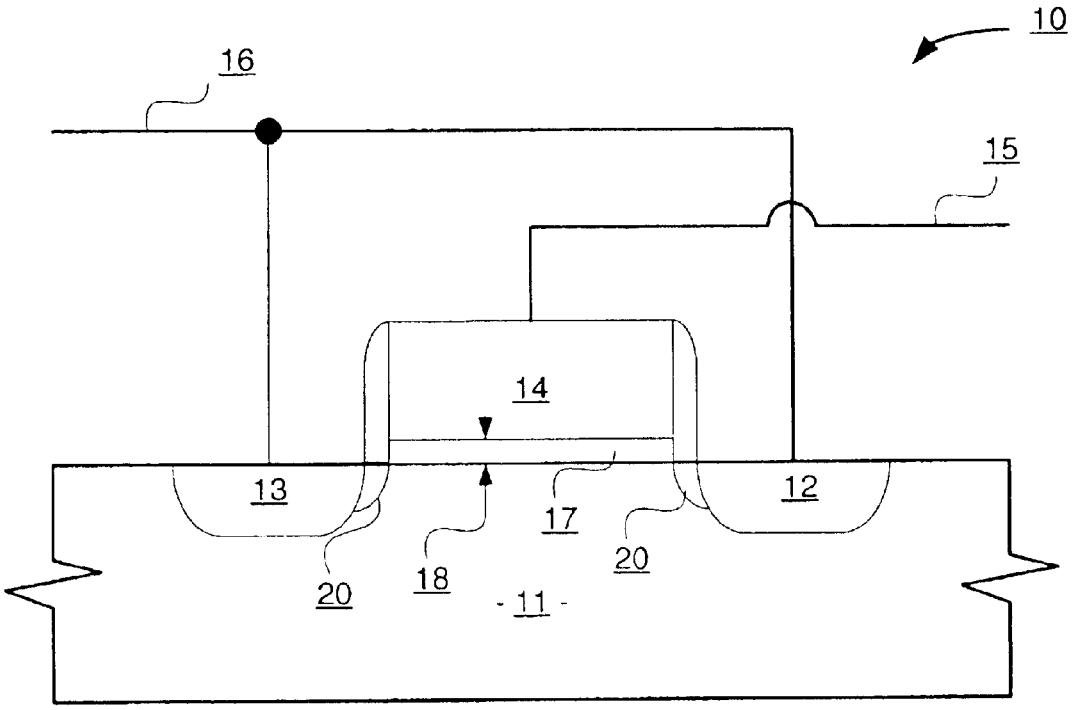
FIGS. 1A, 1B and 1C are cross-sectional views of exemplary embodiments of nonlinear current devices in accordance with one or more aspects of the present invention.

Referring to FIG. 1A, there is shown a cross-sectional view of an exemplary embodiment of a nonlinear current device 10 in accordance with one or more aspects of the present invention. Nonlinear current device 10 comprises a thin-gate MOSFET having a source region 12 connected to a drain region 13 at a terminal 16 and having a conductive gate region 14 connected at a separate terminal 15. Alternatively, as shown in the schematic diagram of FIG. 1B, drain region 13 may be floating, and thus not tied to source region 12. Also, alternatively, as shown in the schematic diagram of FIG. 1C, drain region 13 may be omitted from nonlinear current device 10. Nonlinear current device 10 may or may not be formed with one or more lightly doped regions 20.

Nonlinear current device 10 further comprises a substrate 11 upon which is formed a gate insulator 17, conventionally a gate oxide or other dielectric, having a thickness 18. Thickness 18 is less than approximately 20 Angstroms such that a gate tunneling current may take place. The amount of tunneling current from gate 14 to substrate 11 (or any conductive inversion layer therein) depends in part on thickness 18 of gate insulator 17, as well as the material used to form gate insulator 17 and the voltage applied to terminal 15.

It should be appreciated that for each angstrom of thickness 18 that gate insulator 17 is reduced, leakage current across gate insulator 17 may approximately double. Conversely, if the gate insulator thickness is increased an angstrom or more, leakage current substantially decreases. Therefore, it has been found that a thickness 18 of less than approximately 20 Angstroms provides a sufficiently leaky transistor to achieve one or more aspects of the present invention. Notably, as circuit elements scale down, circuit element 10 will scale as device elements are formed with smaller dimensions. Element 10 will also scale with any unintended process variations between one die and another or one wafer and another.

Although FIG. 1A shows a MOSFET transistor, it is not necessary that the nonlinear current device actually include both source and drain regions, or that even one source or drain region be included. In one embodiment, only one of the source or drain regions is included. In yet another embodiment, a conductive contact is made to the channel region beneath gate region 14, so that the nonlinear leakage current may be accessed directly. Examples of nonlinear current device 10 are shown and described herein below. It should be appreciated that tunneling current is being used advantageously by treating a MOSFET as a nonlinear circuit element 10 by configuring it as a two terminal device and making use of the current passing between the two terminals. Using feedback to set an operating point, current may be nonlinearly adjusted.

Figure 1B:
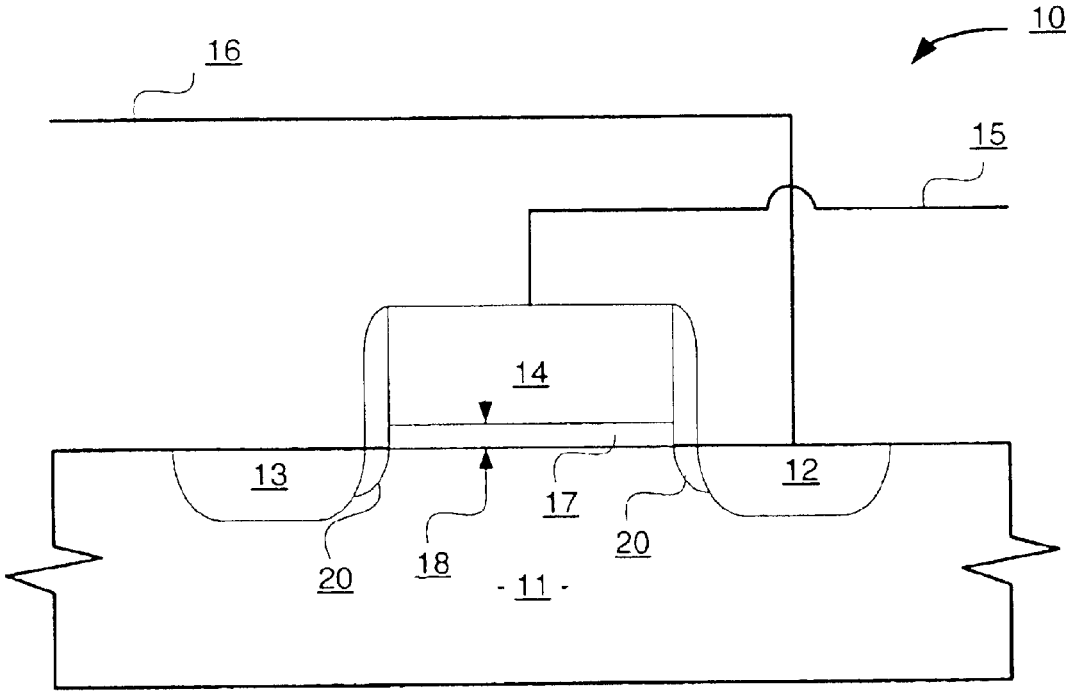
Figure 1C:
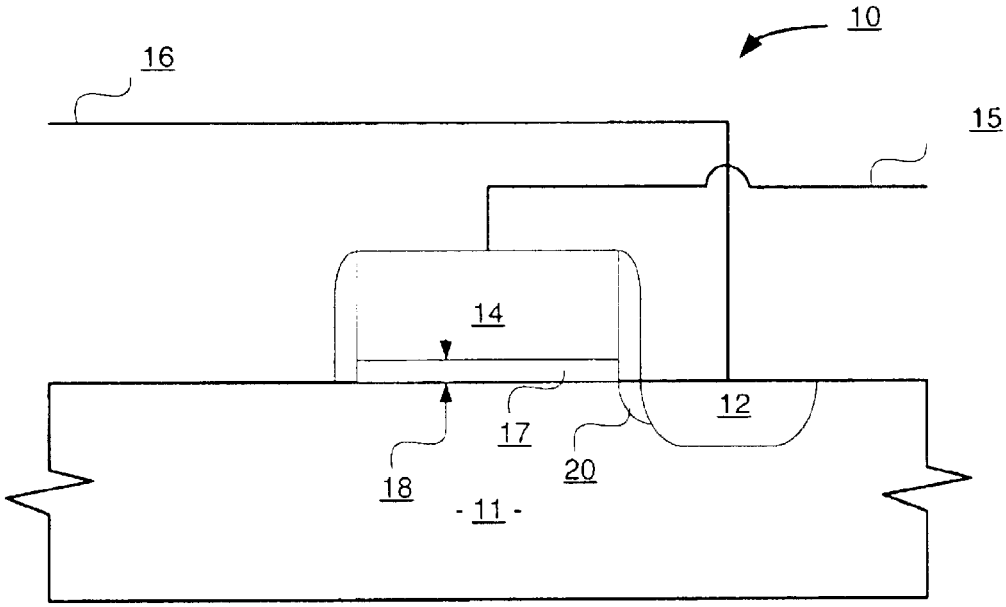
Figure 2:
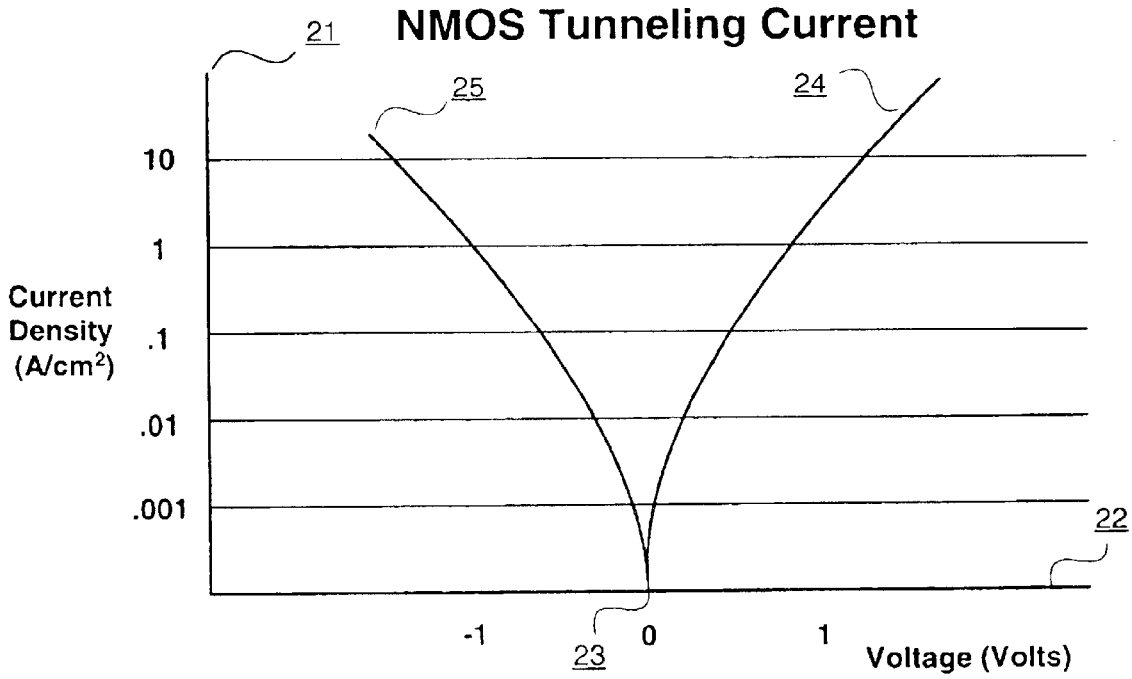
FIG. 2 is a graphic view of a characteristic plot of applied voltage versus current density for the nonlinear current device of FIG. 1A, 1B or 1C.

Referring to FIG. 2, there is shown a graphic view of a characteristic plot of applied voltage 22 versus current density 21 for nonlinear current device 10 of FIG. 1A, 1B or 1C. The curve in FIG. 2 is a semi-log curve having a linear x-axis and a logarithmic y-axis. From approximately zero volts at location 23, current density monotonically increases in both directions of the x-axis. Current density increases along curve 24 with a positive slope as applied voltage 22 increases. While not wishing to be bound by theory, it is believed that this current is caused by tunneling of electrons across gate insulator 17. When applied voltage 22 is swept from location 23 in a negative voltage direction, current density monotonically increases along curve 25 with a negative slope. It is believed that this current is caused by holes tunneling across gate insulation layer 17.

The near-linear shape of the two portions of the curve indicate a near exponential increase of current with increasing voltage over several orders of magnitude. Notably, characteristic curves 24 and 25 are similar for NMOS and PMOS devices, in that tunneling current nonlinearly increases with voltage 22 applied to gate 14 in either direction away from the flat-band voltage of the device (approximately zero volts).

Figure 3:
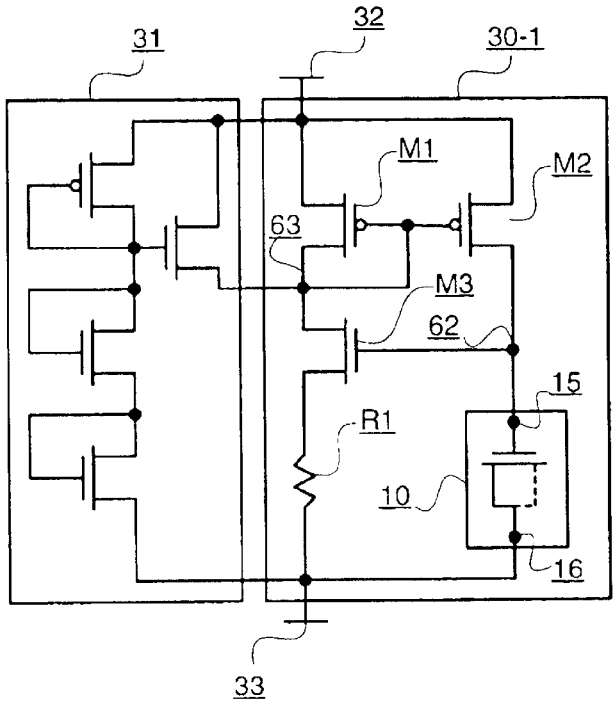
FIG. 3 is a schematic diagram of an exemplary embodiment of a current-source self-biasing circuit in accordance with one or more aspects of the present invention.

Referring to FIG. 3, there is shown a schematic diagram of an exemplary current-source self-biasing circuit 30-1 in accordance with one or more aspects of the present invention. Current-source self-biasing circuit 30-1 is coupled between potentials 32 and 33, which may be a voltage source such as $V_{DD}$ and a voltage return such as $V_{ss}$. Typically, when a circuit such as shown in FIG. 3 starts to power up, there is no current passing from a node at potential 32 to a node at potential 33, and all nodes are at zero volts. As voltage 32 increases, the low voltage at node 63 tends to hold the current mirror stuck at zero current. A start-up circuit 31 may be coupled to circuit 30-1 to prompt circuit 30-1 out of this stable state.

Figure 4:
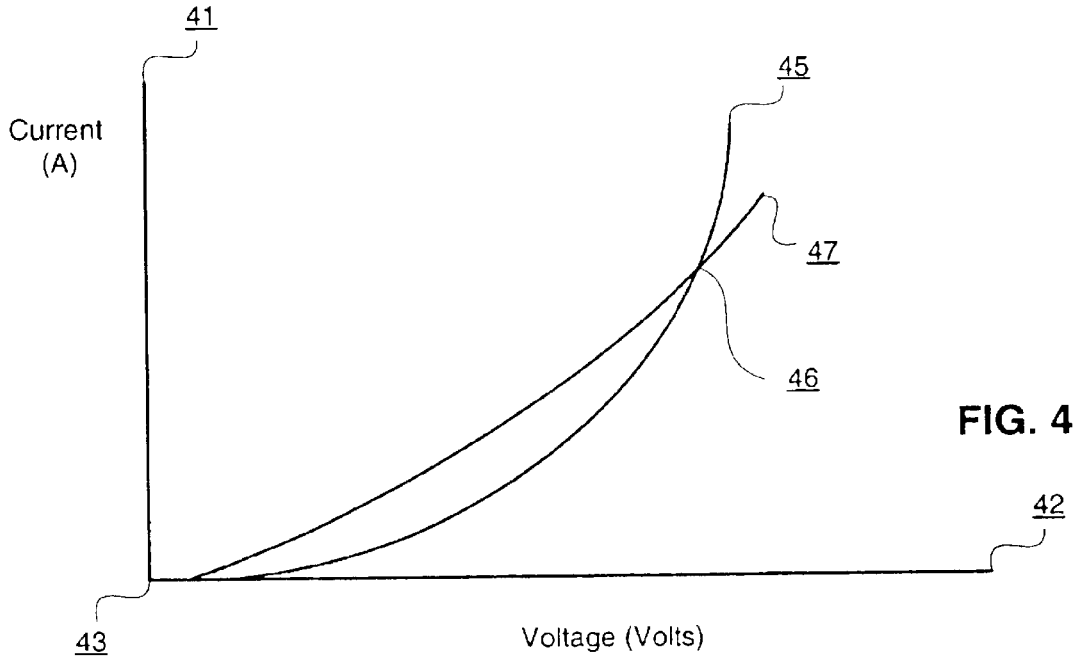
FIG. 4 is a voltage versus current graph of exemplary embodiments of current source self-biasing circuits in accordance with one or more aspects of the present invention.

Referring to FIG. 4, there is shown a voltage 42 versus current 41 graph (both scales are linear) of exemplary embodiments of current source self-biasing circuits in accordance with one or more aspects of the present invention. Voltage 42 and current 41 are both 0 at location 43. Location 43 is one stable state of current-source self-biasing circuit 30-1. Another stable state of current source self-biasing circuit 30-1 is location 46. Line 47 represents current passed by device M3 in response to voltage at node 62 and curve 45 represents voltage and current across nonlinear current device 10.

For a stable state 43 for which current and voltage are equal to 0, a start up circuit 31 (FIG. 3) may be used to get out of or avoid such a state. Well-known details regarding self-biasing circuits and their stable states may be found in "CMOS Circuit Design, Layout, and Simulation" by R. Jacob Baker, Harry W. Li and David E. Boyce, published by IEEE Press Series on Microelectronic Systems in 1998, at pages 469–484.

It should be appreciated that transistors M1 and M2 form a current mirror circuit, as is well known. Transistor M2 has a width W and a length L. Transistor M1 may be sized such that it is (W/L)×K, for K a design variable. Accordingly, current through M3 when in a conductive state will be approximately K×I, for current I into node 15 where it is assumed that M1 and M2 are in the saturation region and that the drain output conductance of each device is negligible. Notably, by sizing transistors M1 and M2, resistor R1 can receive a current multiplied by a factor of K. Thus, in order to use a relatively small resistor for R1, a scaling factor K may be used that is greater than one. Alternatively, K may be less than or equal to one. If the reference is properly designed, tunneling current across nonlinear current device 10 will be adjusted such that the current through R1 and nonlinear current device 10 are ratioed the same as design variable K. In other words, for the case of K equal to one, tunneling current across nonlinear current device 10 will be stabilized at approximately the same current through resistor R1, as indicated in FIG. 4 by location 46.

Figure 5:
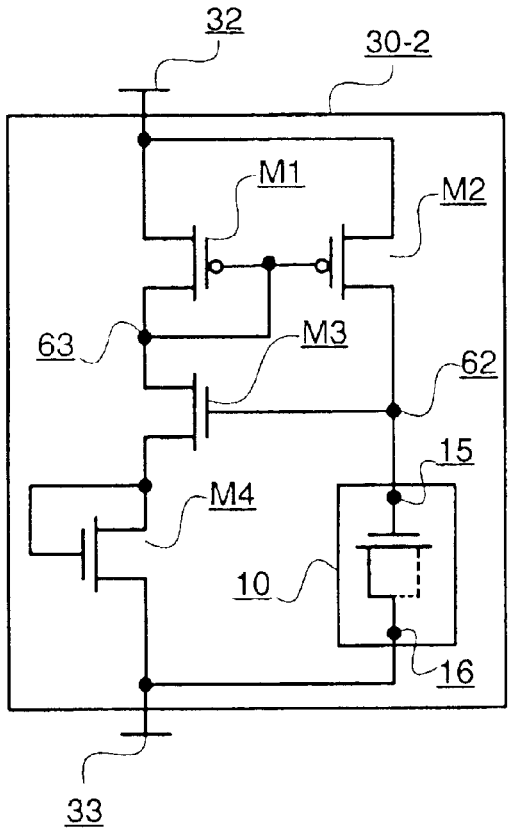
FIG. 5 is a schematic diagram of an exemplary current source self-biasing circuit in accordance with one or more aspects of the present invention.

Referring to FIG. 5, there is shown a schematic diagram of an exemplary embodiment of a current-source self-biasing circuit 30-2 in accordance with one or more aspects of the present invention. Current-source self-biasing circuit 30-2 of FIG. 5 is similar to current-source self-biasing circuit 30-1 of FIG. 3, except resistor R1 has been replaced with transistor M4. Though a start-up circuit 31 is not shown in FIG. 5, it should be appreciated that a start-up circuit 31 may be coupled to current-source self-biasing circuit 30-2 to avoid or get out of stable state 43 to move into stable state 46. Advantageously, by using a transistor M4 instead of a resistor R1 the issue of forming a resistor, especially a large resistor, which conventionally takes up a significant amount of semiconductor wafer area, is avoided. Again, transistor M1 may be sized to be larger by a factor K than transistor M2. Loop gain for this circuit may be described by the following expression with effective resistance, $R_x$, of tunneling device 10, as:

$$[G_{M3}/(1+G_{M3}/G_{M4})]\times(1/K)\times R_x \quad (1)$$

While transistors M1 and M2 may be sized to produce a relationship where a factor K may be used as a multiplier for current, it would be undesirable for transistors M1 and-M3 not to operate in their saturation regions. (e.g. the saturation region is approximately where Vds≧Vgs−Vt.) Therefore K is selected such that these devices do not fall out of this range. Also, the loop gain for this circuit should be less than +1 or it will begin to function as a latch instead of the intended bias circuit.

Figure 6:
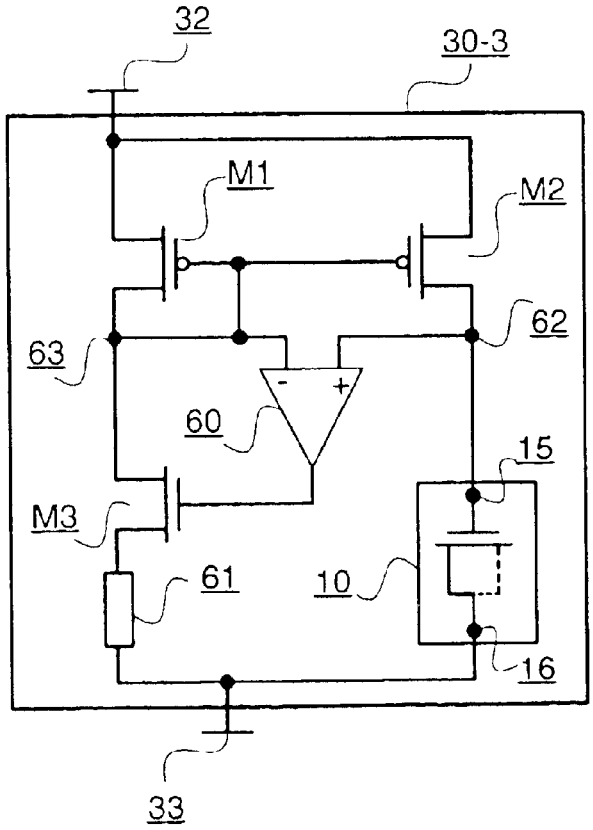
FIG. 6 is a schematic diagram of another exemplary current source self-biasing circuit.

Referring to FIG. 6, there is shown a schematic diagram of an exemplary embodiment of a source current self-biasing circuit 30-3 in accordance with one or more aspects of the present invention. Again, for purposes of clarity, start-up circuit 31, or another well-known start-up circuit, is not shown, though current source self-biasing circuit 30-3 may be coupled to such a start-up circuit. In place of resistor R1 or transistor M4 is box 61, representing a resistive load supplied by either a resistor or a transistor or a combination thereof. Operational amplifier 60 receives voltages at nodes 62 and 63 into positive and negative inputs, respectively. Operational amplifier 60 will attempt to adjust input voltages from nodes 62 and 63 to a same. potential. Accordingly, operational amplifier 60 provides an output voltage to increase or decrease current flow across transistor M3. Output voltage from operational amplifier 60 to a gate of transistor M3 causes transistor M3 to operate in a saturation region. Thus, transistor M3 will pass some current, including any leakage current, to load device 61. Because current flowing across transistor M3 is received at load device 61, causing a voltage drop, voltage across load 61 is seen at node 63 except for the voltage drop across transistor M3. Nonlinear current device 10 is useful for creating a bias voltage in order that voltages 62 and 63 equalize. Thus, using nonlinear current device 10 as a circuit element advantageously uses leakage current. This leakage current or tunneling current effectively is used to provide a nonlinear resistor at low frequencies.

Figure 7:
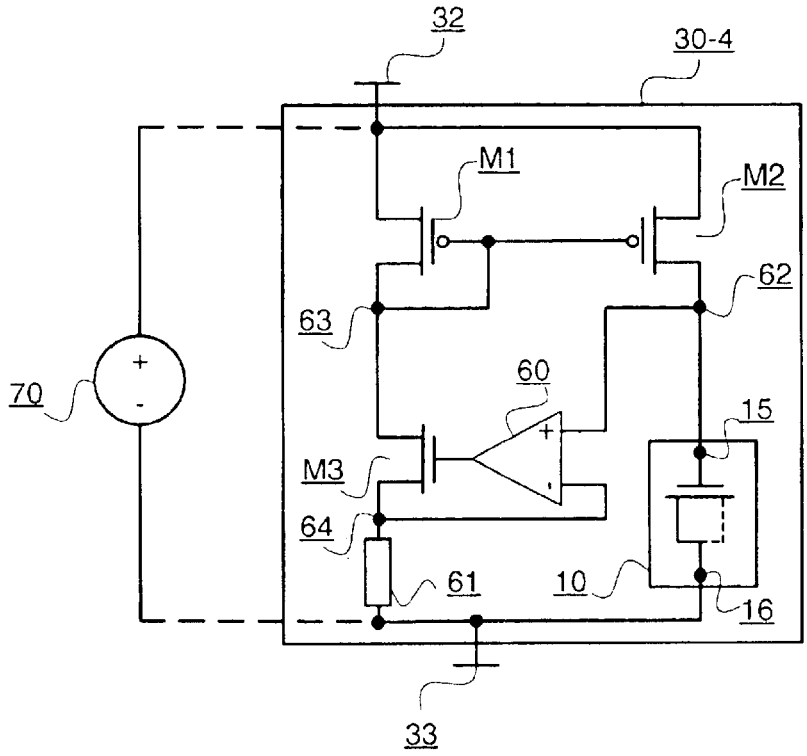
FIG. 7 is a schematic diagram of yet another exemplary current source self-biasing circuit.

Turning to FIG. 7, there is shown a schematic diagram of an exemplary embodiment of a current source self-biasing circuit 30-4 in accordance with one or more aspects of the present invention. Again, start-up circuit 31, or another well-known start-up circuit, is not shown for purposes of clarity, though current-source self-biasing circuit 30-4 may be coupled to such a start-up circuit.

In this embodiment, operational amplifier 60 is configured to receive positive and negative input voltages from nodes 62 and 64, respectively. Operational amplifier 60 will therefore attempt to equalize voltages at nodes 62 and 64. In other words, a voltage drop across load 61 appearing at node 64 will be equalized to the voltage drop across nonlinear current device 10 appearing at node 62. Nonlinear current device 10 will display tunneling current corresponding to voltage at node 62. So, if voltage at node 64 is lower than voltage at node 62, operational amplifier 60 will apply more voltage to gate transistor M3 such that more current flows across transistor M3, namely from node 63 to node 64, and in response, voltage at node 64 will increase. Thus, the operational amplifier will effectively force a fixed ratio of currents flowing into nodes 62 and 64.

of course, signs of inputs, namely positive and negative inputs, of operational amplifier 60 may be reversed depending upon loop gain from each input. Moreover, size of nonlinear current device 10 or ratio of sizes of transistors M1 and M2, namely K, or a combination thereof, may be used to adjust needed load 61 for forming current source self-biasing circuit 30-4. Moreover, sizes of resistor R1 and/or transistor M4, as mentioned above for forming load 61, may be adjusted. Advantageously, it should be appreciated that current source self-biasing circuit 30-4 has only a slight temperature dependence as it only depends upon the temperature coefficient of the effective resistance of block 61 and the temperature coefficient of tunneling of device 10. Normally, these two characteristics are both well defined and relatively small in comparison with references that depend upon individual MOSFET performance.

Figure 8:
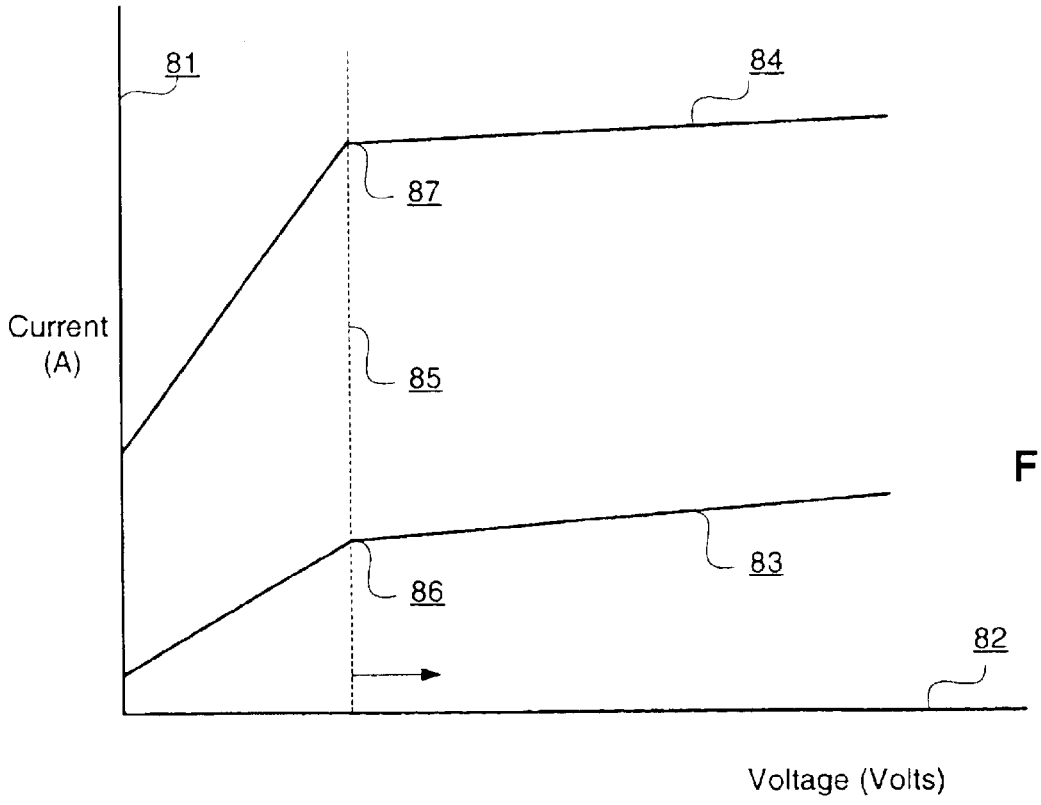
FIG. 8 shows a graph of supply voltage versus nodal current for a design in accordance with the current source self-biasing circuit of FIG. 7.

Referring to FIG. 8, there is shown a graph of supply voltage 82 versus nodal current 81 for K equal to 3 in an application of current source self-biasing circuit 30-4 of FIG. 7. Voltage source 70 (FIG. 7) is coupled to current source self-biasing circuit 30-4 to provide a supply voltage thereto. In an implementation of current source self-biasing circuit 30-4, a start up circuit, as described above, may be coupled to current source self-biasing circuit 30-4 in addition to voltage power supply 70. Curve 84 represents current into load 61, and curve 83 represents current into node 15.

A line 85 may be drawn to delineate two states for operation of current source self-biasing circuit 30-4. Line 85 passes through locations 86 and 87, of curves 83 and 84, respectively. To the left of line 85 is a region of operation of the current source self-biasing circuit 30-4 that is below the normal operating voltage and which is not supply insensitive. In this region, it is believed that the transistors within the current source self-biasing circuit 30-4 are not in the desired operating regions and hence display less than desirable power supply sensitivity. To the right of line 85 is a more supply independent operating region of current-source self-biasing circuit 30-4 and is the intended operating region. As may be seen, in this operating region, lines 83 and 84 have a much smaller slope than in the lower supply voltage region. In other words, current into load 61 and current into nonlinear current device 10 when current source self-biasing circuit 30-4 is in this normal operating state changes relatively little with changes of the supply voltage 70. This indicates that current source self-biasing circuit 30-4 is substantially independent of changes in supply voltage 70 after this normal operating state has been reached.

Though curves 83 and 84 do exhibit some slope within such an operating region, to some extent this is due to limitations of a current mirror formed by transistors M1 and M2, owing to finite impedance thereof. Such slopes may be further reduced by using a cascode of current mirrors, as is known. Such a cascode of current sources may be a double cascode current source or an active feedback scheme such as "gain boosting" that results in improved performance.

Accordingly, it should be appreciated that MOS processes, whether PMOS or NMOS, may be used to form current source self-biasing circuits in accordance with one or more aspects of the present invention. Such current source self-biasing circuits are not as sensitive to process drift and temperature as conventional current source self-biasing circuits. Furthermore, what was previously a negative characteristic, namely, gate leakage current due to tunneling, is used in an advantageous manner. Current-source self-biasing circuits in accordance with one or more aspects of the present invention may be formed with a MOS-only process technology. Moreover, because MOS devices are used, lower operating voltages may be used than would be required with BJT use.

While the foregoing is directed to several preferred embodiments of the present invention, other and further embodiments of the invention may be devised without departing from the basic scope thereof, and the scope thereof is determined by the claims that follow. For example, rather than NMOS transistors, PMOS transistors may be used or both NMOS and PMOS transistors may be used. And a conductive contact attached to the substrate may be used as one terminal of the nonlinear current density device.

What is claimed is:

1. A current source self-biasing circuit, comprising:

a current mirror circuit configured to sense a first current being presented at a first node and provide a second current to a second node;

a current controlling transistor having a current carrying terminal coupled to the first node and configured to modify current in response to a gating voltage;

a first resistive load coupled to receive current passed drain-to-source through the current controlling transistor, the first resistive load coupled to a third node; and a second resistive load configured to receive the second current, the second resistive load comprising a nonlinear current density device, the nonlinear current density device having a gate and a source region, the gate and source region being separated by a dielectric capable of conducting a tunneling current, the source region being coupled to the third node, the gate coupled to the second node in order to receive the second current, a drain region of the nonlinear current density device being coupled to the source region via the third node.

2. The circuit of claim 1 wherein the gate and source region of the nonlinear current density device are a gate and a source region of a transistor, and the dielectric capable of conducting a tunneling current is a gate dielectric of the transistor.

3. The circuit of claim 2 wherein the source region and the drain region are directly connected to one another at the third node.

4. The circuit of claim 1 wherein the nonlinear current density device comprises a substrate region of a semiconductor device and a conductive region of the semiconductor device located above the substrate region and separated from the substrate region by the dielectric capable of conducting a tunneling current.

5. The circuit of claim 4 wherein the conductive region of the semiconductor device located above the substrate region is a transistor gate, and the substrate region is a transistor channel region adjacent to the source region and the drain region.

6. The current source self-biasing circuit of claim 1 wherein the first resistive load is provided by a resistor.

7. The current-source self-biasing circuit of claim 1 wherein the first resistive load is provided by a resistive load transistor.

8. The current-source self-biasing circuit of claim 1 wherein the gating voltage is provided by an amplifier.

9. The current-source self-biasing circuit of claim 8 wherein the amplifier comprises a first input terminal coupled to the first node and a second input terminal coupled to the second node.

10. The current-source self-biasing circuit of claim 8 wherein the amplifier comprises a first input terminal coupled to the first resistive load and a second input terminal coupled to the second resistive load.

11. The current source self-biasing circuit of claim 1 wherein the current controlling transistor is coupled to the second node to receive the gating voltage.

12. A method of providing a current source self-biasing circuit, comprising:

providing a current mirror circuit coupled to sense a first current and provide a second current;

gating the first current sensed to a first resistive load; and providing at least a portion of the second current to a second resistive load, the second resistive load provided with a transistor, the transistor having a gate, a drain region, and a source region, the transistor having a gate insulator of limited thickness for providing passage of leakage current from the gate to the source region, the gate receiving the portion of the second current to the second resistive load, the drain region and the source region electrically coupled to one another without having to induce any channel therebetween.

13. The method of claim 12, wherein the drain region and the source region are connected to one another.

14. The method of claim 12, wherein the source region is connected to an output terminal.

15. The method of claim 12, wherein the gate insulator has a thickness of less than approximately 20 Angstroms.

16. A current source self-biasing circuit, comprising:

a current mirror circuit configured to sense a first current being presented at a first node and provide a second current to a second node;

a current controlling transistor having a current carrying terminal coupled to the first node and configured to modify current in response to a gating voltage;

a first resistive load coupled to receive current passed drain-to-source through the current controlling transistor, the first resistive load coupled to a third node; and a second resistive load configured to receive the second current, the second resistive load comprising a nonlinear current density device, the nonlinear current density device having a gate and a source region, the gate and source region being separated by a dielectric capable of conducting a tunneling current, the source region being coupled to the third node;

the gate and source region of the nonlinear current density device respectively being the gate and source region of a transistor, the dielectric capable of conducting the tunneling current being a gate dielectric of the transistor, the source region of the transistor including spaced apart source and drain regions of the transistor connected to one another at the third node.

17. A method of providing a current source self-biasing circuit, comprising:

providing a current mirror circuit coupled to sense a first current and provide a second current;

gating the first current sensed to a first resistive load; and providing at least a portion of the second current to a second resistive load, the second resistive load provided with a transistor, the transistor having a gate and a source region, the transistor having a gate insulator of limited thickness for providing passage of leakage current from the gate to the source region;

the transistor including a drain region, the drain region and the source region being connected to one another.

18. A current source self-biasing circuit, comprising:

a current mirror circuit configured to sense a first current being presented at a first node and provide a second current to a second node;

a current controlling transistor having a current carrying terminal coupled to the first node and configured to modify current in response to a gating voltage;

a first resistive load coupled to receive current passed through the current controlling transistor, the first resistive load coupled to a third node; and a second resistive load configured to receive the second current, the second resistive load provide with a non-linear current density device, the nonlinear current density device having a gate and a source region, the gate and the source region being separated by a dielectric capable of conducting a tunneling current, the source region being coupled to the third node, the gate being coupled to the second node, the non-linear current density device being a two-terminal device having one less terminal than a transistor.

19. The circuit of claim 18, wherein the nonlinear current density device does not comprise a drain region.

20. The circuit of claim 18, wherein the nonlinear current density device comprises a drain region.

* * * * *